US011957212B2

(12) United States Patent
Steidle

(10) Patent No.: US 11,957,212 B2
(45) Date of Patent: Apr. 16, 2024

(54) ADAPTABLE FOOTWEAR FOR PLAYING FOOTBALL

(71) Applicant: Concave Global Pty Ltd, Richmond (AU)

(72) Inventor: Volker Peter Steidle, Richmond (AU)

(73) Assignee: Concave Global Pty Ltd, Richmond (AU)

( * ) Notice: Subject to any disclaimer, the term of this patent is extended or adjusted under 35 U.S.C. 154(b) by 15 days.

(21) Appl. No.: 15/556,292

(22) PCT Filed: Mar. 7, 2016

(86) PCT No.: PCT/AU2016/050158
§ 371 (c)(1),
(2) Date: Sep. 6, 2017

(87) PCT Pub. No.: WO2016/141427
PCT Pub. Date: Sep. 15, 2016

(65) Prior Publication Data

US 2018/0035746 A1 Feb. 8, 2018

(30) Foreign Application Priority Data

Mar. 6, 2015 (AU) ..... 2015900807

(51) Int. Cl.
*A43B 5/02* (2006.01)
*A43B 3/00* (2022.01)
(Continued)

(52) U.S. Cl.
CPC ..... *A43B 5/025* (2013.01); *A43B 3/0031* (2013.01); *A43B 5/18* (2013.01); *A43B 19/00* (2013.01);
(Continued)

(58) Field of Classification Search
CPC ..... A43B 5/025; A43B 5/02; A43B 3/0031; A43B 5/18; A43B 19/00; A43B 23/027;
(Continued)

(56) References Cited

U.S. PATENT DOCUMENTS 3,650,051 A * 3/1972 Sass ..... A43B 5/02 36/133
3,703,775 A * 11/1972 Gatti ..... A43B 5/02 36/128
(Continued)

FOREIGN PATENT DOCUMENTS

DE 359081 A2 * 3/1990 ..... A43B 5/02
FR 2 293 884 A1 7/1976
(Continued)

OTHER PUBLICATIONS

International Search Report and Written Opinion dated May 10, 2016, issued in corresponding International Application No. PCT/AU2016/050158, filed Mar. 7, 2016, 9 pages.
(Continued)

*Primary Examiner* — Jameson D Collier
(74) *Attorney, Agent, or Firm* — Christensen O'Connor Johnson Kindness PLLC

(57) ABSTRACT

A football shoe or football boot including a sole, an upper, a fastener to fasten the shoe or boot in place, and a layer of material that in situ is disposed between the fastener and an underlying foot or hose. The layer of material includes a ball control region with an outer ball control surface contactable with a football during kicking. The ball control surface lies rearwardly of a foremost region of the layer of material.

22 Claims, 7 Drawing Sheets

(51) Int. Cl.
*A43B 5/18* (2006.01)
*A43B 19/00* (2006.01)
*A43B 23/02* (2006.01)
*A43B 23/26* (2006.01)

(52) U.S. Cl.
CPC ..... *A43B 23/027* (2013.01); *A43B 23/0275* (2013.01); *A43B 23/26* (2013.01)

(58) Field of Classification Search
CPC ..... A43B 23/0275; A43B 23/26; A43C 7/00; A43C 7/02; A43C 19/00
USPC ..... 36/54, 114, 128, 133, 136
See application file for complete search history.

(56) References Cited

U.S. PATENT DOCUMENTS 4,065,861 A * 1/1978 Pelfrey ..... A43B 5/02 36/133
4,377,913 A * 3/1983 Stone ..... A43C 11/1493 36/50.1
5,170,575 A * 12/1992 Pelfrey ..... A43B 5/02 36/113
5,209,000 A * 5/1993 Rowland ..... A43B 1/0072 2/245
5,459,947 A * 10/1995 Lasher ..... A43C 1/00 24/306
6,237,253 B1 * 5/2001 Feuerecker ..... A43B 5/002 36/113
6,421,936 B1 * 7/2002 Gerrand ..... A43B 5/02 36/133
6,681,503 B2 * 1/2004 Morle ..... A43B 5/02 36/133
7,941,943 B2 * 5/2011 Baker ..... A43B 5/02 36/133
2002/0043007 A1 * 4/2002 Hannah ..... A43B 5/02 36/133
2005/0144812 A1 * 7/2005 Wheeler ..... A43B 3/0078 36/133
2008/0016717 A1 * 1/2008 Ruban ..... A43B 23/022 36/21
2009/0100712 A1 4/2009 Baker et al.
2009/0100713 A1 4/2009 Adami et al.
2009/0113766 A1 5/2009 Hooper
2010/0180468 A1 * 7/2010 Pelletier, Jr. ..... A43B 7/20 36/99
2010/0275463 A1 * 11/2010 Gallagher ..... A43B 5/025 36/133
2012/0233888 A1 9/2012 Baker et al.
2012/0317836 A1 * 12/2012 Voorhees ..... A43B 23/26 12/146 C
2015/0352419 A1 * 12/2015 Pappas ..... A63B 69/002 473/422

FOREIGN PATENT DOCUMENTS

GB 1293925 A * 10/1972 ..... A43B 5/02
IT 496931 A1 * 8/1992 ..... A43B 5/02
KR 20090042096 A 4/2009
WO WO-9622712 A1 * 8/1996 ..... A43B 5/02
WO WO-0076336 A1 * 12/2000 ..... A43B 5/18
WO WO-2013028217 A2 * 2/2013 ..... A43B 3/0005
WO 2014/183170 A1 11/2014

OTHER PUBLICATIONS

Extended European Search Report dated Oct. 8, 2018, issued in corresponding Application No. EP 16 76 0930, filed Mar. 7, 2016, 8 pages.
Japanese Notice of Reasons for Rejection dated Feb. 24, 2021, issued in corresponding Japanese Application No. 2017-544923, filed Aug. 24, 2017, 5 pages.

* cited by examiner

ADAPTABLE FOOTWEAR FOR PLAYING FOOTBALL

FIELD OF THE INVENTION

This invention relates generally to footwear worn when playing football. The invention is suitable for all codes including soccer, rugby, and Australian, American, and Gaelic football but is especially useful when playing what is known in most countries as football and distinguished in others as soccer.

BACKGROUND OF THE INVENTION

There have been a number of proposals over time for football shoes or boots with uppers to enhance the outcome of kicking a ball. For example, U.S. Pat. No. 6,421,936 discloses a football shoe having an upper with an instep defined by a pair of longitudinally extending spaced-apart ridges laterally of a transversally concave surface for substantially cupping a ball that contacts the instep. The upper further has a toe region and the ridges have, at their front ends behind the toe region, front surfaces with respective upper peaks.

The broad concept of a concave ball contacting surface is also disclosed in European patent 359081, in which a pair of ridges are disposed along the sides of the lace region, and in European patent 496931 in which the concave surface extends from a planar shoe tip almost to the ankle opening. International patent publication WO1996/022712 describes a soccer shoe in which a mix of external leather patches and ribs in the toe region are thought to give the player a more accurate control of the ball during kicking.

With the configuration of U.S. Pat. No. 6,421,936, objective tests have established that the modified upper increases the departure velocity of the ball when all other factors are substantially equal, and subjective player experience is that the configuration increases kicking accuracy. Both these benefits are clearly valuable when kicking for goal in soccer and other football codes. However, player experience is that football shoes with modified uppers of the kinds disclosed in the aforementioned patents can be less comfortable than unmodified shoes, especially when running down the ground, because of reduced flexibility in the upper. This was a reason why the modified region is set back behind the toe region in embodiments described in U.S. Pat. No. 6,421,936, and in a commercial shoe made pursuant to that patent and marketed as CONCAVE™ football boots.

Another modified football shoe is disclosed in U.S. Pat. No. 7,941,943. This shoe includes a ball control insert containing one or more protruding ball control surfaces that are mounted within a flap portion which overlies the tongue. Whilst this modified shoe may enhance ball kicking ability, the location and extent of the ball control insert may be uncomfortable for the wearer, particularly when running.

To address the need to provide a more comfortable football shoe with enhanced ball kicking, the applicant developed a shoe, disclosed in International patent publication WO2014/183170, in which the generally rigid ball control region is located substantially rearwardly of the toe region within a flap that overlies the tongue. Due to its substantially rearward position, the rigid ball control region of this football shoe does not impose or impress upon the bridge or toes of the wearer's foot, thereby providing a more comfortable fit.

While these shoes have been found beneficial for their improved kicking accuracy and ball speed, players have suggested that comfort might further be improved during running, and have also expressed some concern about the additional weight of the shoe arising from the inserted material to achieve the modified upper configuration.

Additionally, some wearers have experienced difficulty in lacing-up shoes which contain the modified upper configuration, or find such shoes to be aesthetically unappealing due to their bulkier size.

It is an object of the invention to at least in part address these concerns.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

It has been realised, in accordance with the invention, that it is possible to address concerns about comfort, weight, ease of use, and aesthetics, and still achieve enhanced ball kicking by supplementing the tongue of the shoe, rather than by modifying the upper, for example, by including a flap on the upper which overlies the tongue (as in prior designs).

In one aspect, the invention provides a football shoe or football boot including a sole, an upper, a fastening means to fasten the shoe or boot in place, and a layer of material that in situ is disposed between the fastening means and an underlying foot or hose, wherein the layer of material includes a ball control region with an outer ball control surface contactable with a football during kicking, and wherein said ball control surface lies rearwardly of a foremost region of the layer of material.

In an embodiment, the layer of material may be a tongue that is attached to the upper or integral with the upper at its forward end. In an alternative embodiment, the layer of material may be attached to or integral with the upper laterally of the ball control region to each side thereof. In this embodiment, the layer of material may extend rearwardly into a collar portion, which collar portion extends about an ankle or lower leg of a wearer when the shoe or boot is worn. In various embodiments, the layer of material may comprise a soft flexible fabric, or may be of a material similar to the upper.

The fastening means preferably comprises lacing, but may also comprise any other known fastening means typical in the art. For example, the fastening means may comprise clasps, clips, straps, bands that may include hook and loop fasteners such as VELCRO® hook and loop fasteners, or the like.

In another aspect, the invention provides a football shoe or football boot including a sole, an upper, and a tongue, wherein the tongue includes a ball control region with an outer ball control surface contactable with a football during kicking, and wherein said ball control surface lies rearwardly of a foremost region of the tongue.

The football shoe or football boot according to first and second aspects of the invention may also include one or more of the additional features described below.

In an embodiment, the ball control region is integral with the layer of material or tongue, or formed with the layer of material or tongue. In an alternative embodiment, the ball control region is provided by a separate element that overlies a region of the layer of material or tongue. In this embodiment, the separate overlying element may be secured or adapted to be secured to the layer of material or tongue. The overlying element may include a portion that contacts an outer surface of the layer of material or tongue, which portion includes the ball control region.

Preferably, the portion of the overlying element that contacts the outer surface of the layer of material or tongue is a first portion, and the overlying element includes a second portion, wherein said second portion of the overlying element is secured or adapted to be secured to the layer of material or tongue. Preferably, the second portion is a relatively thin elongate portion which is located generally forward of, or extending from, the first portion.

In an embodiment, said second portion of the overlying element is adapted to be secured to the layer of material or tongue by being adapted to be received within a slit, or within a slit defining a pocket, in the outer surface of the layer of material or tongue. Advantageously, by being adapted to be secured to the layer of material or tongue, the overlying element may be a separate interchangeable piece.

In an alternative embodiment, the overlying element, for example by way of the second portion thereof, may be secured to the layer of material or tongue by being stitched, welded, or otherwise fastened to the tongue.

According to an embodiment of the first aspect of the invention, the ball control region is preferably dimensioned such that it lies generally within a region defined by plural eyes, apertures, or inner sleeves in the upper, said plural eyes, apertures, or inner sleeves being adapted to receive the fastening means to fasten the shoe or boot in place. In an embodiment having an overlying element, the element may be dimensioned such that, when secured to the layer of material, the element is generally received within the region defined by the plural eyes, apertures, or inner sleeves.

According to an embodiment of the second aspect of the invention, the ball control region is preferably dimensioned such that it lies generally within an opening in the upper defined by opposing lateral edges of the upper. In an embodiment having an overlying element, this element may be dimensioned such that, when secured to the tongue, it is received generally within the opening in the upper defined by the opposing lateral edges of the upper. Typically, said opposing lateral edges of the upper include plural eyes, apertures, or inner sleeves for receiving lacing, said lacing adapted to secure the shoe to a wearer's foot by closing the opening in the upper to the appropriate extent.

Preferably, said overlying element also includes plural eyes or apertures for receiving lacing, such that, when the football shoe or football boot is worn, the position of the overlying element relative to the layer of material or within the opening in the upper may be controlled.

Advantageously, the ball control region comprises a transversely curved outer ball control surface between respective lateral ridge portions. Preferably, said transversely curved outer ball control surface presents a concave surface, at least when contacted with a football during kicking.

Preferably, said lateral ridge portions of said ball control region are inwardly tapered rear to front. Furthermore, said lateral ridge portions are preferably curved inwardly and downwardly when viewed from a transverse cross-section and define, at their edges, outwardly extending shoulders which include the plural eyes or apertures for receiving lacing.

According to an embodiment of the second aspect of the invention, the tongue preferably extends further rearwardly than a rearmost edge of the overlying element and in addition advantageously provides cushioning between the rearmost edge of the overlying element and the wearer's ankle.

Preferably the upper comprises a flexible material for the wearer's optimum comfort, whereas the ball control region may typically include relatively more rigid material for defining the ridge portions and the transversely curved outer ball control surface, thereby imparting a greater velocity to a ball kicked by contact with the upper including the ball control region.

As used herein, except where the context requires otherwise, the term "comprise" and variations of the term, such as "comprising", "comprises" and "comprised", are not intended to exclude further additives, components, integers or steps.

BRIEF DESCRIPTION OF THE DRAWINGS

The invention will now be further described, by way of example only, with reference to the accompanying drawings, in which.

DETAILED DESCRIPTION OF AN EMBODIMENT

Figure 1:
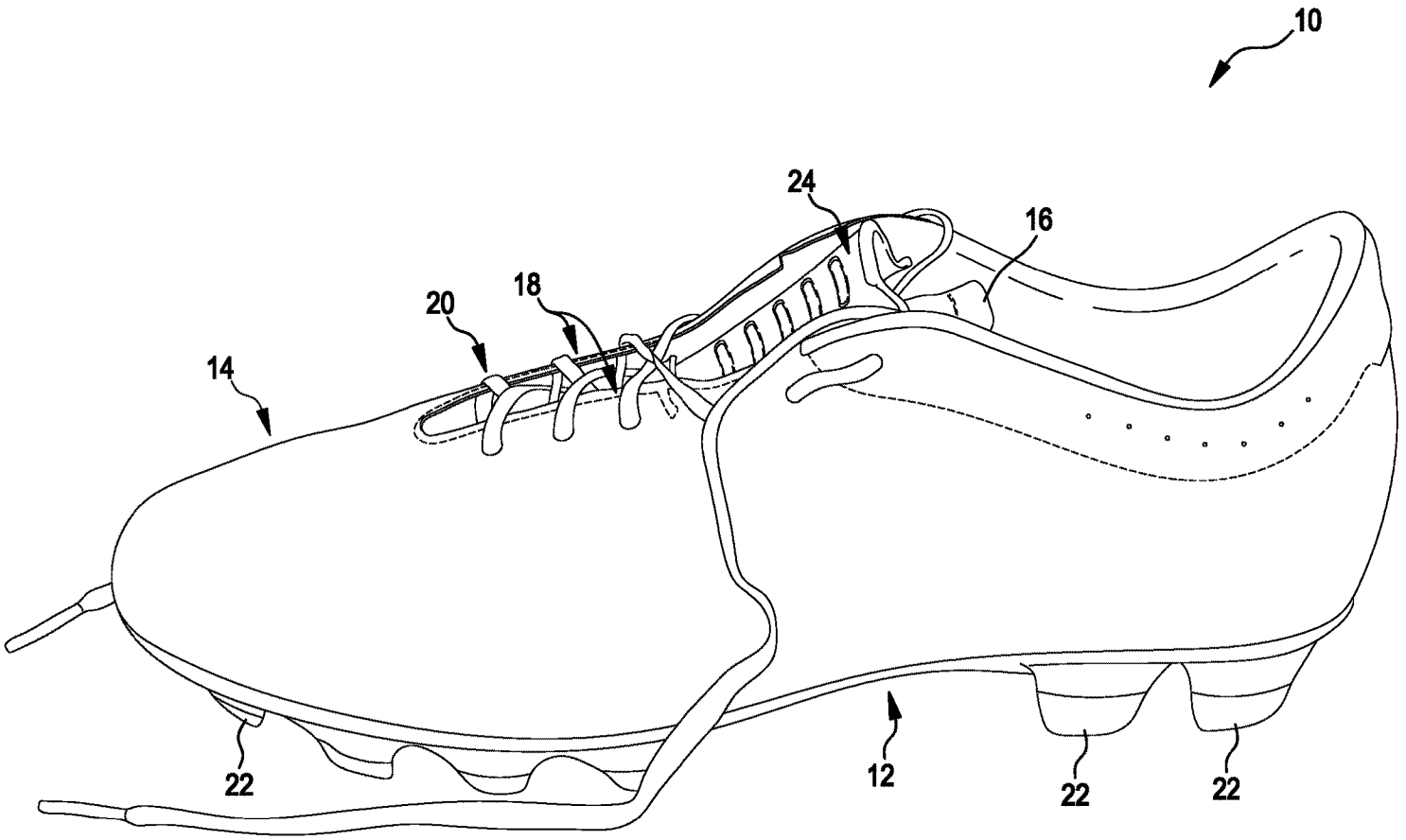
FIG. 1 is a front outer side perspective view of a left football shoe according to an embodiment of the invention.

The illustrated embodiment of a football shoe 10 is designed especially for playing the form of football also known in some countries as soccer. It includes a sole 12, an upper 14, and a tongue 16. The upper 14 and tongue 16 are fashioned in a suitable highly flexible leather or polymer material as is typical in the art. The upper 14 includes opposing lateral edges 18 which define a longitudinally extending lace-up opening 20 in the upper 14. The sole is provided with an array of studs 22. Typically, the studs 22 include interchangeable aluminium tips (not shown). The sole 12, the upper 14, the tongue 16, and studs 22 are made and assembled by known techniques.

In accordance with an embodiment of the invention, the tongue 16 includes an overlying element in the form of a generally elongate insert 24 that is secured to the tongue 16.

Figure 2:
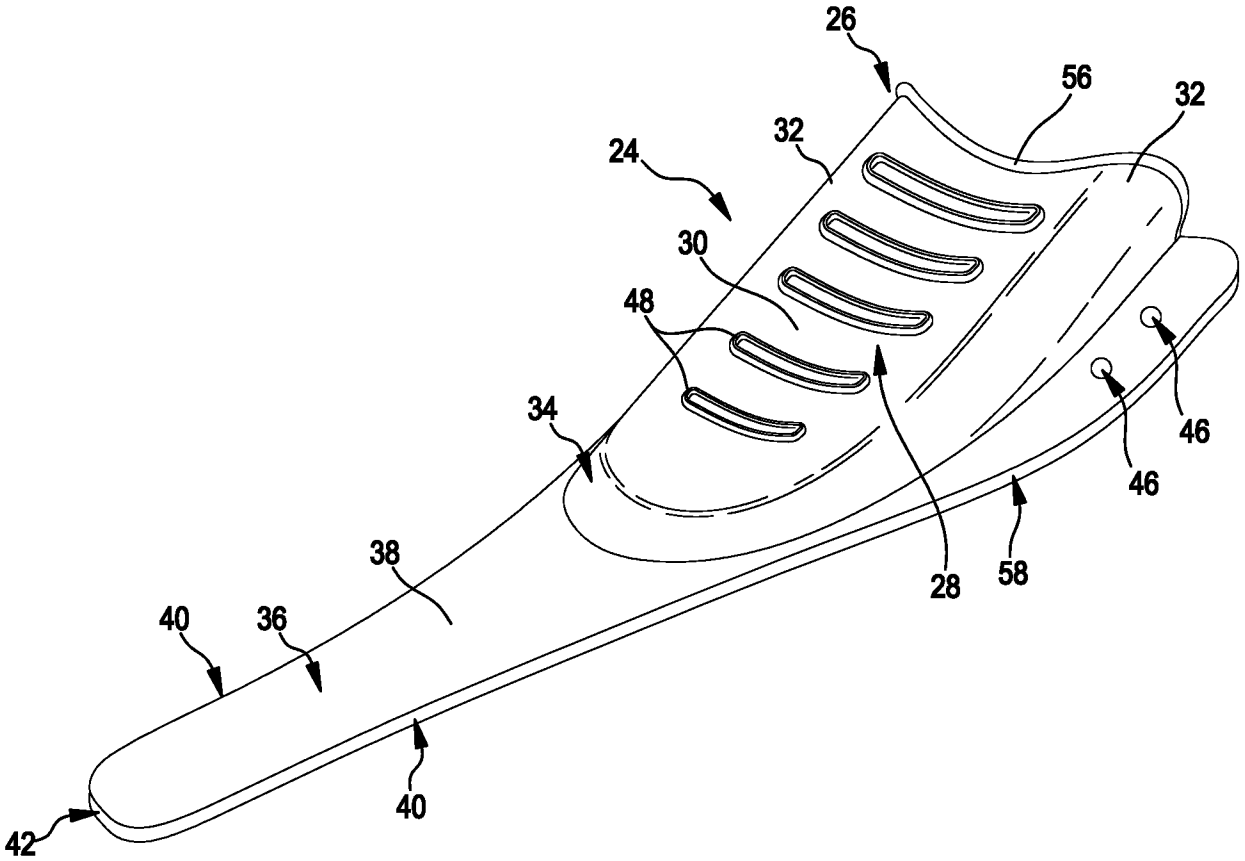
FIG. 2 is a side perspective view of an overlying element that is adapted to be secured to the shoe shown in FIG. 1.

Referring to FIG. 2, the insert 24 includes a first, or upper, portion 26 having a ball control region 28 of substantially rigid material. Ball control region 28 exhibits an outer transversely curved or concave ball control surface 30 between respective lateral ridge portions 32. Outer ball control surface 30 is contactable with a football during kicking. At the outside of the insert upper portion 26, lateral ridge portions 32 curve generally downwardly and then inwardly to form an inverted U in transverse cross-section, and then turn outwardly to terminate in lengthwise extending edge portions 44 (see FIG. 3). Edge portions 44 are sloped generally transversely downwardly and include plural eyes or apertures 46 for receiving shoe lacing, as described below.

Both concave surface 30 and lateral ridge portions 32 are inclined generally downwardly from a rear edge 56 of insert 24 to a transversely curved shoulder 34 located generally midway along the insert 24. Ridge portions 32 merge smoothly into shoulder 34, which defines a generally U-shaped formation joining the ridge portions 32. The curved shoulder 34 provides a downwardly sloped transition from the ball control region 28 to a second, or forward, portion of the insert 24 in the form of a relatively thin elongate tab portion 36. The thin elongate tab portion 36 also exhibits a transversely concave surface 38 between respective lateral edges 40, albeit the concave surface 38 is substantially shallower in profile as compared to the concave surface 30 of the ball control region 28. The lateral edges 40 of the elongate tab portion 36 taper inwardly, and the tab portion 36 terminates at a generally semi-circular forward end 42 that joins the lateral edges 40. The lateral edges 40 of the tab portion 36 also merge with lateral edges 58 of the outwardly extending edge portions 44 at or about the transversely curved shoulder 34.

Advantageously, concave surface 30 also includes spaced shallow transverse grooves or channels 48 that assist in contacting a football during kicking.

Figure 3:
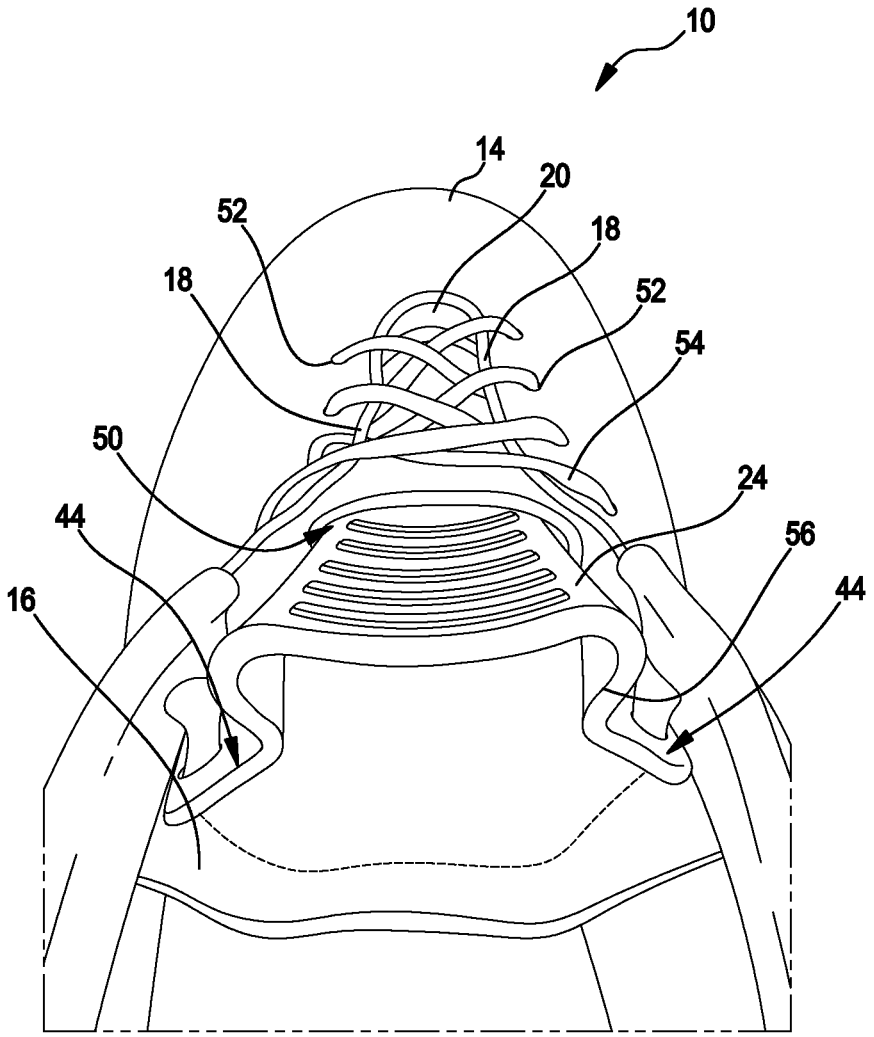
FIG. 3 is a rear top-down perspective view of the shoe shown in FIG. 1.
Figure 4:
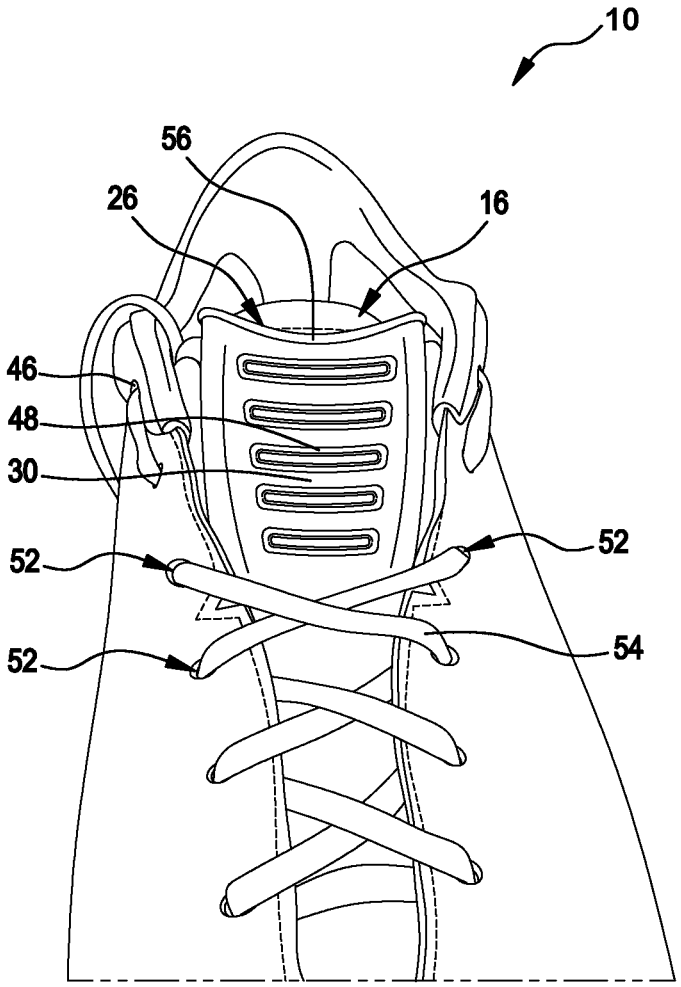
FIG. 4 is a front top-down perspective view of the shoe shown in FIGS. 1 and 3.

In accordance with an embodiment of the invention, and as shown in FIGS. 3 and 4, the insert 24 is secured to the tongue 16 by stitching (not shown). During manufacturing of the shoe 10, the insert 24 is slidably received in a transverse slit or opening 50 (see FIG. 3) in the outer surface of the tongue 16. The slit or opening 50 in the tongue 16 is located generally near a longitudinal midpoint of the opening 20 that separates the opposing lateral edges 18 of the upper 14. The insert is pushed down into the slit 50 until the transversely curved shoulder 34 of the insert 24 is generally located at or near the slit 50. Once received through the slit 50, the insert 24 is stitched to the tongue 16 by suitable stitching located generally forward of the slit in the tongue.

In an alternative embodiment of the invention, the insert may be adapted to be secured to the tongue by being slidably received in a pocket defined by the slit or opening 50. In this embodiment, the wearer can easily secure the insert 24 to the tongue 16 by simply grasping the insert 24 about its upper portion 26, and thereafter, sliding the elongate tab portion 36 of the insert 24 down the outer surface of the tongue 16 and into the pocket defined by the opening 50.

As shown in FIG. 3, when the insert 24 is properly received in the opening 50, the first or upper portion 26 of the insert 24 contacts the outer surface of the tongue 16, and the ball control surface 30 lies rearwardly of a foremost region of the tongue 16. Also, in this position, the tongue 16 extends further rearwardly than the rear edge 56 of the insert 24. Advantageously, this arrangement provides cushioning between a rearmost edge of the outwardly extending edge portions 44 of the insert 24 and the wearer's ankle.

It is contemplated that a variety of inserts 24 may be used with shoe 10. The inserts may differ in overall shape, including the length of the elongate tab portion 36, the profile of the transversely curved ball control surface 30, and the number and profile of the transverse grooves or channels 48. Advantageously, a particularly shaped insert 24 may be selected depending upon the requirements of the day, for example, for wet weather conditions or otherwise. Furthermore, the insert 24 is adapted to be secured to the tongue 16 whilst the shoe 10 is being worn, or prior to being worn.

A person skilled in the art will appreciate that the ball control region 28 comprising the outer ball control surface 30 may be integral with the tongue 16, or may be formed from the tongue. In this arrangement, a separate insert 24 is not required to be secured or adapted to be secured to the tongue 16.

In the illustrated embodiment, the shape of the insert 24 is such that, when secured to the outer surface of the tongue 16 (as shown in FIG. 4), the insert 24 is generally received within the longitudinally extending opening 20 in the upper 14. In this position, the curved lateral ridge portions 32 of the insert 24 are substantially adjacent the respective lateral edges 18 of the upper 14, and the outwardly extending edge portions 44 of the insert 24 are generally aligned with plural eyes or apertures 52 in the upper 14. Advantageously, lacing 54 can then be received through the aligned apertures 52, 46 of the upper 14 and insert 24 respectively (see FIG. 1). Thereafter, the insert 24 is securely fastened to the tongue 16, by being received in the opening 50 and by lacing 54.

Figure 5:
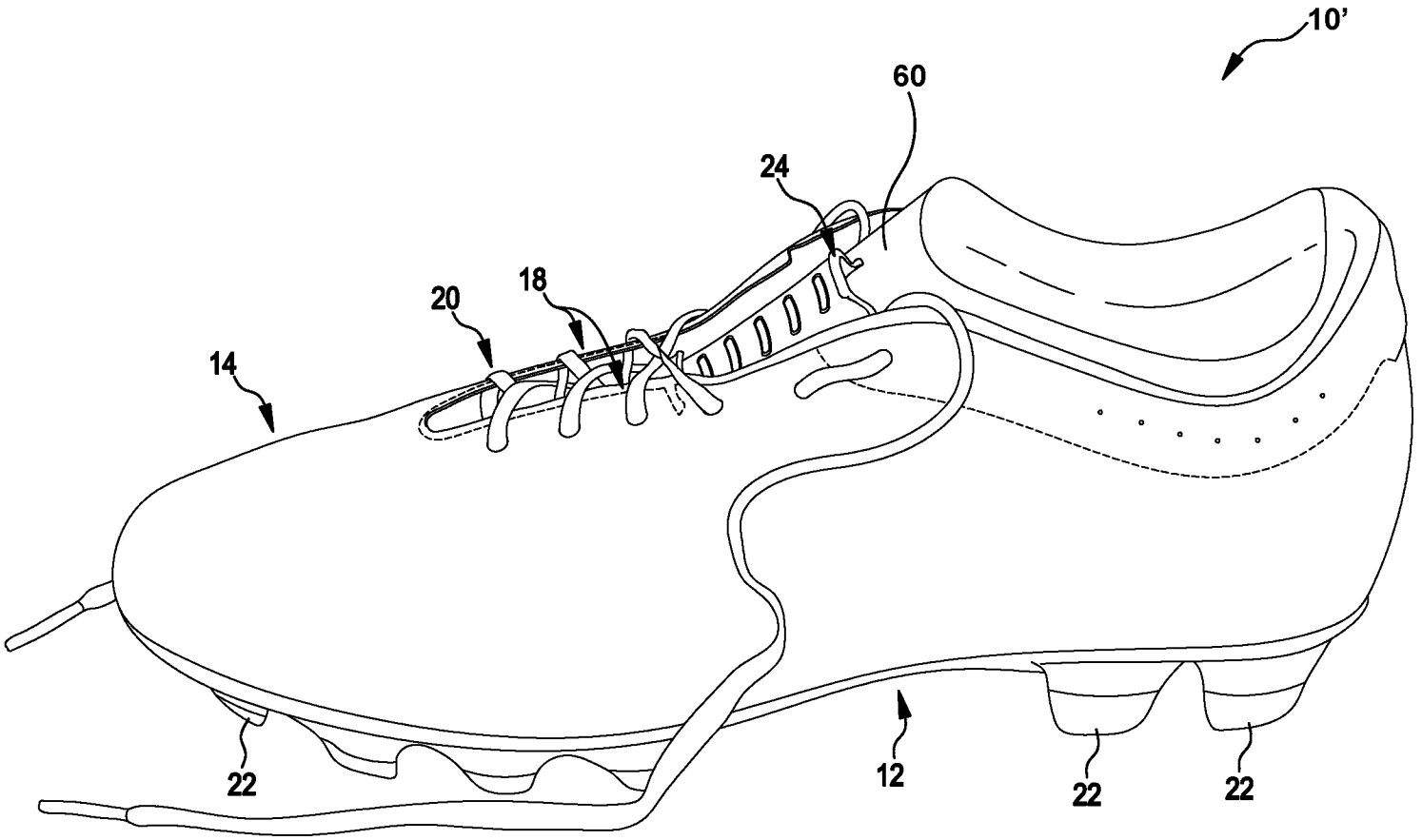
FIG. 5 is a side perspective view of a left football shoe according to another embodiment of the invention.
Figure 6:
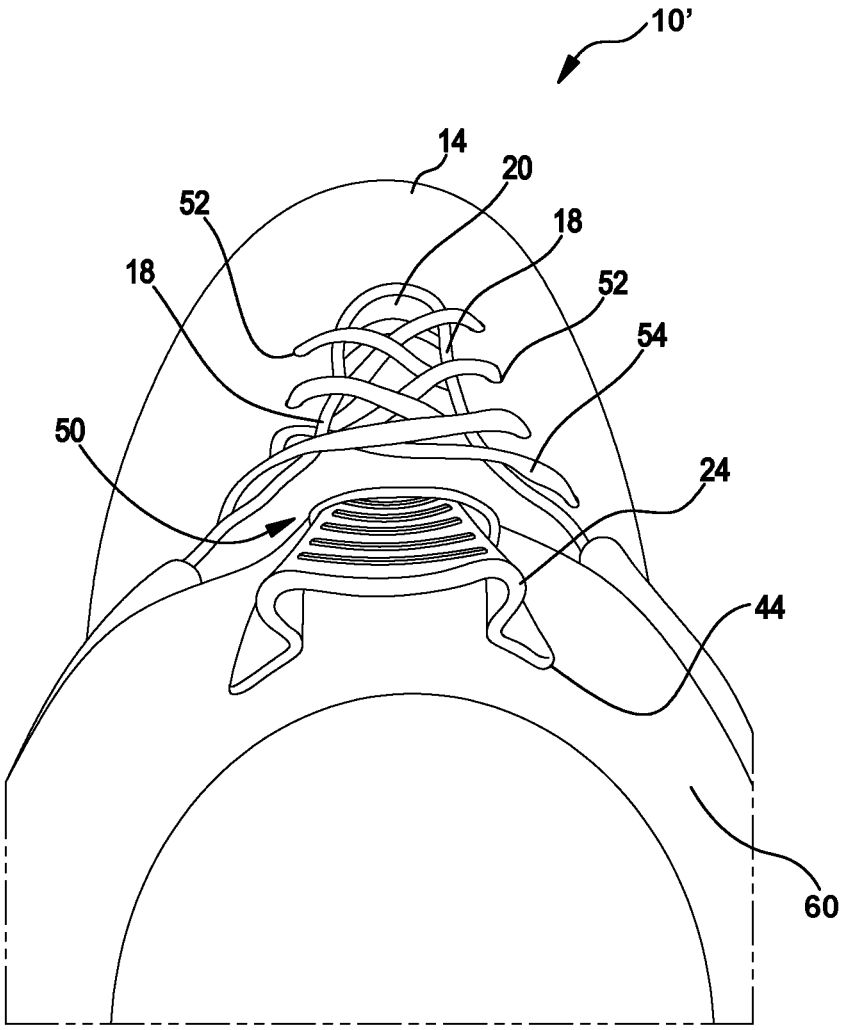
FIG. 6 is a rear top-down perspective view of the shoe shown in FIG. 5.
Figure 7:
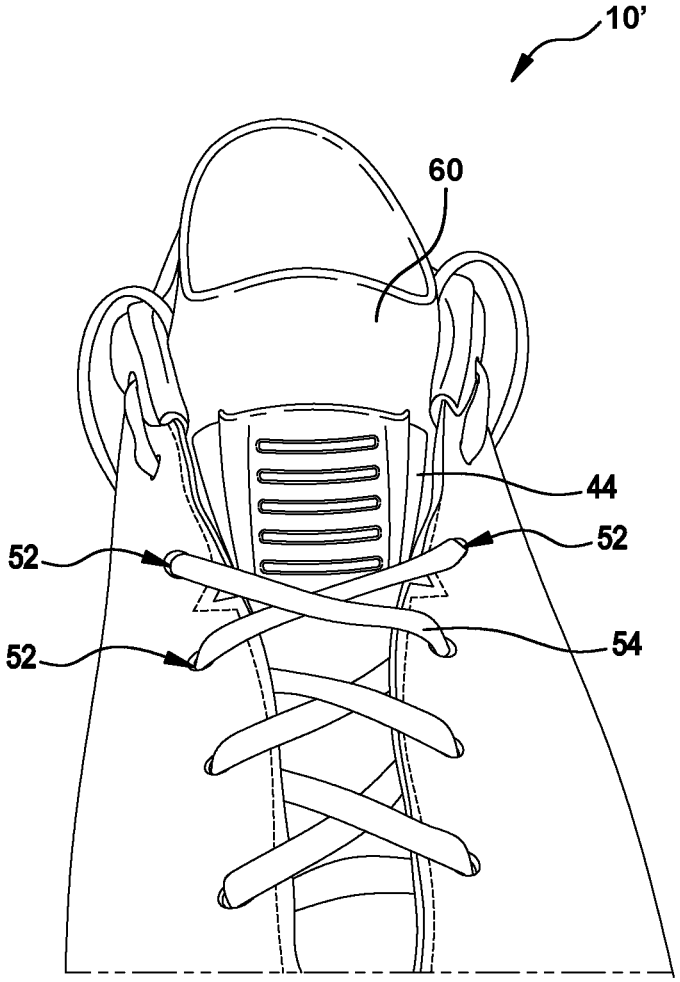
FIG. 7 is a front top-down perspective view of the shoe shown in FIGS. 5.

In an alternative embodiment of the invention shown in FIGS. 5-7, another football shoe or football boot 10' is provided. This shoe or boot 10' is similar to that illustrated in FIGS. 1, 3 and 4, but includes a continuous upper 14 comprising a soft flexible material. The shoe 10' further includes a layer of material 60 integral with the upper 14 laterally of the ball control region to each side thereof. The layer of material 60 is disposed between a fastening means comprising lacing and an underlying foot or hose. The layer of material 60 extends rearwardly into a collar portion that extends about an ankle or lower leg of a wearer when the shoe 10' is worn. This shoe is of the sort marketed commercially by Nike, Inc. as MAGISTA® footwear.

The football shoe or boot further includes an overlying element in the form of a generally elongate insert that is secured to the layer of material in a manner similar to that shown in FIGS. 1, 3, and 4. The insert is of the sort illustrated in FIG. 2 and includes a ball control region with an outer ball control surface contactable with a football during kicking. The ball control surface lies rearwardly of a foremost region of the layer of material.

The elongate insert is slidably received in a transverse slit or opening in an outer surface of the layer of material. Once received through the slit, the insert is stitched to the layer of material by suitable stitching located generally forward of the slit in the layer of material. In an alternative non-illustrated embodiment, the insert may be adapted to be secured to the layer of material by being slidably received in a pocket defined by the slit or opening.

In a further alternative non-illustrated embodiment of this invention, the layer of material may be a tongue that is attached to the upper or integral with the upper at its forward end.

The shoe configurations described above retain the advantageous feature of a ball control surface 30 that substantially cups a ball as it is kicked to thereby improve the accuracy and velocity of the kick, whilst maintaining a flexible and comfortable upper, especially when the wearer is running. At the same time, the described shoes are substantially easier to lace-up as compared to prior shoes with modified uppers. Furthermore, by eliminating the need to modify the upper, the described shoes are generally lighter and aesthetically pleasing.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A football shoe or football boot comprising a sole, an upper, a fastening means to fasten the shoe or boot in place, and a layer of material that is configured to be disposed between the fastening means and an underlying foot or hose, wherein the layer of material includes a ball control region which is integral with the layer of material or formed with the layer of material, the layer of material being attached to or integral with the upper laterally of the ball control region to each side of the ball control region, such that the upper is continuous laterally of the ball control region, wherein the ball control region comprises a transversely curved outer ball control surface between respective lateral ridge portions, wherein the transversely curved outer ball control surface is contactable with a football during kicking, wherein said transversely curved outer ball control surface lies rearwardly of a foremost region of the layer of material, wherein the ball control region is dimensioned such that the ball control region lies generally within a region defined by opposing plural eyes, apertures, or inner sleeves in the upper, said plural eyes, apertures, or inner sleeves being adapted to receive the fastening means.

2. The football shoe or football boot of claim 1, wherein the transversely curved outer ball control surface presents a concave surface.

3. The football shoe or football boot of claim 1, wherein the layer of material extends rearwardly into a collar portion, wherein the collar portion extends about an ankle or lower leg of a wearer when the shoe or boot is worn.

4. The football shoe or football boot of claim 1, wherein the lateral ridge portions of the ball control region are inwardly tapered rear to front.

5. The football shoe or football boot of claim 1, wherein each of the lateral ridge portions, at a forward extent of the ball control region, is inclined downwardly so as to diminish in height.

6. The football shoe or football boot of claim 1, wherein the lateral ridge portions of the ball control region have a forward extent that lies rearwardly of a foremost extent of the fastening means.

7. The football shoe or football boot of claim 1 wherein the layer of material comprises a soft flexible material and the lateral ridge portions of the ball control region comprise a relatively more rigid material than the soft flexible material.

8. A football shoe or football boot comprising a sole, an upper having opposing lateral edges defining an opening, a fastening means configured to fasten the shoe or boot in place, and a tongue that is, in situ, configured to be disposed between the fastening means and an underlying foot or hose, wherein the tongue is attached to or integral with the upper at a forward end of the tongue, wherein the football shoe or football boot further includes a ball control region provided by an element in the form of an insert having lateral edges, wherein the insert overlies a region of the tongue and is secured or adapted to be secured to the tongue, wherein the ball control region provided by the insert comprises a transversely curved outer ball control surface between respective lateral ridge portions, and the insert further includes edge portions at the lateral edges of the insert, wherein the transversely curved outer ball control surface is contactable with a football during kicking, wherein said transversely curved outer ball control surface lies rearwardly of a foremost region of the tongue, and wherein the ball control region is dimensioned such that, in situ, the ball control region lies generally within a region defined by opposing plural eyes, apertures, or inner sleeves in the upper, said plural eyes, apertures or inner sleeves being adapted to receive the fastening means, and wherein the ball control region is dimensioned such that, in situ, the ball control region lies within the opening in the upper defined by the opposing lateral edges of the upper, with the lateral ridge portions being substantially adjacent to respective ones of the lateral edges of the insert, and the edge portions of the insert being substantially beneath respective ones of the opposing lateral edges of the upper.

9. The football shoe or football boot of claim 8, wherein the transversely curved outer ball control surface presents a concave surface.

10. The football shoe or football boot of claim 8, wherein the lateral ridge portions of the ball control region are curved inwardly and downwardly when viewed from a transverse cross-section.

11. The football shoe or football boot of claim 8, wherein the tongue extends further rearwardly than a rearmost edge of the ball control region, and the tongue is configured to provide cushioning between the rearmost edge of the ball control region and a wearer's ankle.

12. The football shoe or football boot of claim 8, wherein the upper comprises a soft flexible material and the ball control region comprises a relatively more rigid material than the soft flexible material for defining the lateral ridge portions of the ball control region and the transversely curved outer ball control surface.

13. The football shoe or football boot of claim 8, wherein each of the lateral ridge portions, at a forward extent of the ball control region, is inclined downwardly so as to diminish in height.

14. The football shoe or football boot of claim 8 wherein the element is secured to the tongue by being stitched or welded to the tongue.

15. The football shoe or football boot of claim 8, wherein the element includes plural eyes or apertures for receiving the fastening means such that, when the shoe or boot is worn, the position of the element relative to the opening in the upper may be controlled.

16. The football shoe or football boot of claim 8, wherein the lateral ridge portions of the ball control region have a forward extent that lies rearwardly of a foremost extent of the fastening means.

17. A football shoe or football boot comprising a sole, an upper, a fastening means to fasten the shoe or boot in place, and a layer of material that is configured to be disposed between the fastening means and an underlying foot or hose, wherein the football shoe or football boot further includes a ball control region provided by an element which overlies a region of the layer of material and is secured to the layer of material, the layer of material being attached to or integral with the upper laterally of the ball control region to each side of the ball control region such that the upper is continuous laterally of the ball control region, wherein the ball control region comprises a transversely curved outer ball control surface between respective lateral ridge portions, wherein the transversely curved outer ball control surface is contactable with a football during kicking, wherein said transversely curved outer ball control surface lies rearwardly of a foremost region of the layer of material, and wherein the ball control region is dimensioned such that, in situ, the ball control region lies generally within a region defined by opposing plural eyes, apertures, or inner sleeves in the upper, said plural eyes, apertures, or inner sleeves being adapted to receive the fastening means.

18. The football shoe or football boot of claim 17 wherein the element is secured to the layer of material by being stitched or welded to the layer of material.

19. The football shoe or football boot of claim 17, wherein the transversely curved outer ball control surface presents a concave surface.

20. The football shoe or football boot of claim 17, wherein the layer of material extends rearwardly into a collar portion, wherein the collar portion extends about an ankle or lower leg of a wearer when the shoe or boot is worn.

21. The football shoe or football boot of claim 17 wherein the layer of material comprises a soft flexible material and the ball control region comprises a relatively more rigid material than the soft flexible material for defining the lateral ridge portions of the ball control region and the transversely curved outer ball control surface.

22. The football shoe or football boot of claim 17, wherein the lateral ridge portions of the ball control region have a forward extent that lies rearwardly of a foremost extent of the fastening means.

* * * * *